US006955330B1

(12) United States Patent
Weiser et al.

(10) Patent No.: US 6,955,330 B1
(45) Date of Patent: Oct. 18, 2005

(54) DECK SECURING SYSTEM

(75) Inventors: Isaac Weiser, Tarzana, CA (US); Margaret Weiser, Tarzana, CA (US); Charles Vanetzian, Medway, MA (US)

(73) Assignee: Exhart Environmental Systems, Inc., Chatsworth, CA (US)

( * ) Notice: Subject to any disclaimer, the term of this patent is extended or adjusted under 35 U.S.C. 154(b) by 0 days.

(21) Appl. No.: 10/846,608

(22) Filed: May 14, 2004

(51) Int. Cl.[7] ..... F16M 13/00
(52) U.S. Cl. ..... 248/529; 43/21.2
(58) Field of Search ..... 248/227.2, 228.1, 248/346.03, 500, 519, 539, 521, 499; 43/21.2; 114/230.1, 218; 410/116

(56) References Cited

U.S. PATENT DOCUMENTS

| | | | | | |
|---|---|---|---|---|---|
| 1,793,910 | A | * | 2/1931 | Cuthbert et al. | 211/69.7 |
| 3,000,599 | A | * | 9/1961 | Honig | 248/515 |
| 3,010,687 | A | * | 11/1961 | Hagberg | 248/515 |
| 3,964,706 | A | * | 6/1976 | Adams | 43/21.2 |
| 4,084,814 | A | * | 4/1978 | Boggild | 482/33 |
| 4,235,409 | A | | 11/1980 | Cummings | 248/538 |
| 4,297,963 | A | | 11/1981 | Beacom | 114/230 |
| 4,836,127 | A | * | 6/1989 | Wille | 114/343 |
| 5,120,016 | A | | 6/1992 | Dysarz | 248/539 |
| 5,148,730 | A | * | 9/1992 | McCaw | 83/745 |
| 5,210,971 | A | * | 5/1993 | Efantis | 43/21.2 |
| 5,632,112 | A | * | 5/1997 | Steinborn | 43/21.2 |
| 5,690,042 | A | | 11/1997 | Bentley | 114/230 |
| 5,746,031 | A | * | 5/1998 | Burns | 52/170 |
| 5,813,163 | A | | 9/1998 | Dysarz | 43/21.2 |
| 5,873,319 | A | | 2/1999 | Bentley | 114/230 |
| 5,921,014 | A | * | 7/1999 | Lee | 43/21.2 |
| 5,961,091 | A | | 10/1999 | Petryna et al. | 248/523 |
| 5,967,075 | A | | 10/1999 | Johansen | 114/230 |
| 6,386,608 | B1 | | 5/2002 | Eister | 294/62 |
| 6,497,067 | B1 | * | 12/2002 | King | 43/21.2 |

* cited by examiner

*Primary Examiner*—Robert P. Olszewski
*Assistant Examiner*—A. Joseph Wujciak
(74) *Attorney, Agent, or Firm*—Cislo & Thomas LLP

(57) ABSTRACT

Exemplary embodiments provided herein include a deck securing system including an extension member, a securing member coupled to the extension member configured to move between a secured position and unsecured position, a receiving member springedly and/or telescopingly coupled to the extension member, an indicator configured to indicate the position of the securing member, and a base member coupled to the extension receiving member.

13 Claims, 3 Drawing Sheets

DECK SECURING SYSTEM

BACKGROUND

Many people may want to place planters, deck umbrellas, and other devices on a deck next to their house or other decking system. Difficulties may arise when an object to be supported is unbalanced, when a strong wind is blowing, or the like. What is needed is a system to couple poles, planters, etc. securely to a deck or decking structure.

SUMMARY

Exemplary embodiments provided herein include a deck securing system including an extension member, a securing member coupled to the extension member configured to move between a secured position and unsecured position, an extension receiving member springedly and/or rotatably coupled to the extension member, an indicator configured to indicate the position of the securing member, and a base member coupled to the extension receiving member.

DETAILED DESCRIPTION

The detailed description set forth below in connection with the appended drawings is intended as a description of one embodiment and is not intended to represent the only forms in which one decking system may be constructed and/or utilized. The description sets forth the functions and the sequence of steps for constructing and operating the disclosed embodiments. However, it is to be understood that the same or equivalent functions and sequences may be accomplished by different embodiments that are also intended to be encompassed within the spirit and scope of the embodiments disclosed herein.

Figure 1:
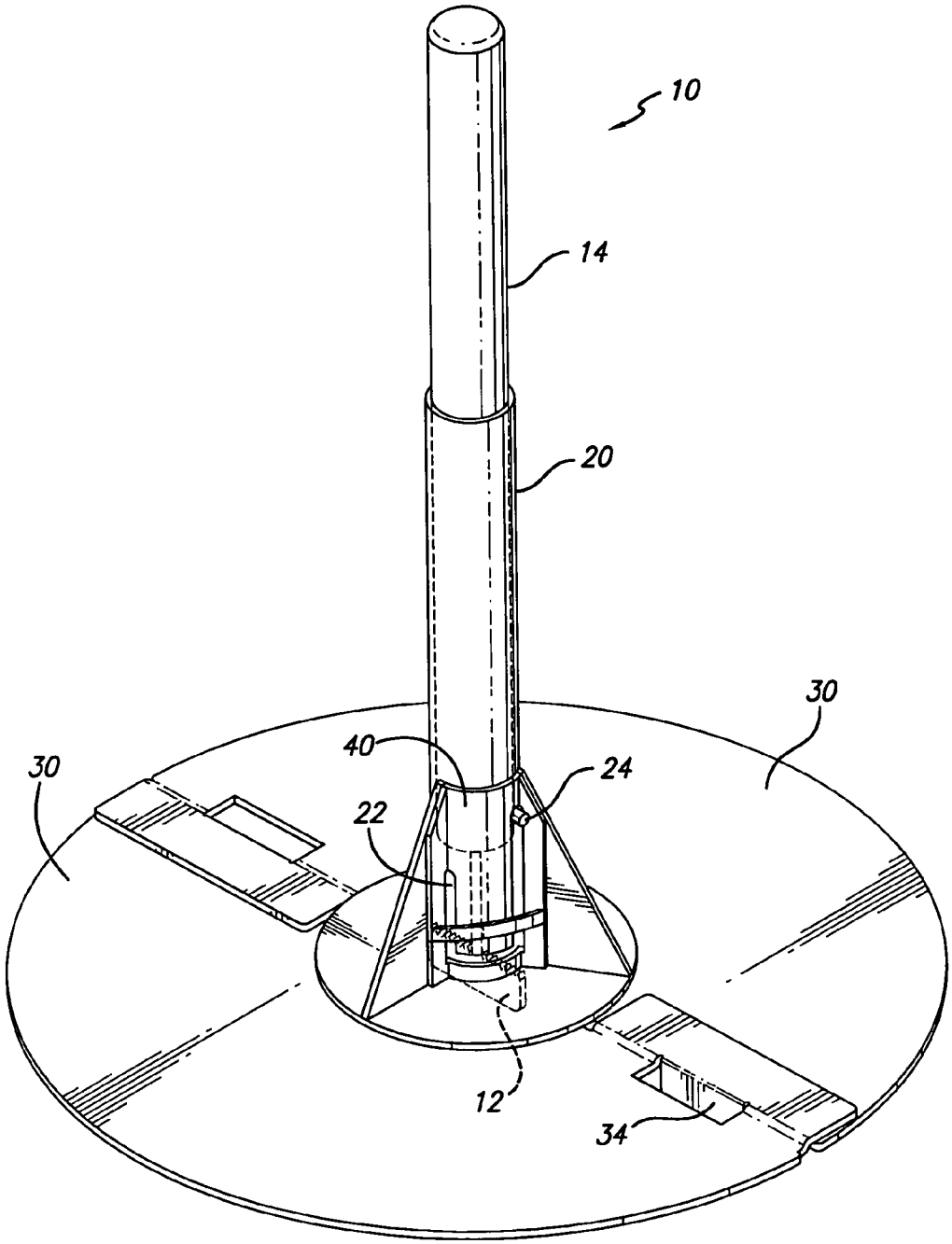
FIG. 1 is a perspective view of one embodiment of our deck securing system.

Like reference numbers are used throughout the figures and specification to denote like structures. FIG. 1 is a perspective view of a deck securing system, generally at 10, which includes an extension member 14, such as a metal rod, springedly and/or rotatably coupled to an extension receiving member 20, configured as a metal cylinder. In this embodiment, system 10 further includes an indicator 24, which indicates the position of extension member 14 with respect to extension receiving member 20, and a securing member 12. Securing member 12 is coupled to extension member 14 via a weld or other configuration, including, but not limited to, bonded via an adhesive or being unitary with extension member 14.

In this embodiment, extension member 14 extends within receiving member 20, and is coupled to it via a spring. With this configuration extension member 14, and consequently securing member 12, rotates with respect to receiving member 20. Securing member 12 is therefore biased towards receiving member 20.

Indicator 24 may be coupled to extension member 14. Alternatively, indicator 24 may be coupled to a securing member 12. In this embodiment, indicator 24 moves within a channel 22, to allow rotation of extension member 14 and securing member 12 with respect to receiving member 20. In this manner securing member 12 may rotate from a secured position to an unsecured position.

System 10 further includes a guide housing 40, which may be coupled to extension receiving member 20. Guide housing 40 may couple to the system 10 in a variety of ways, including, but not limited to, with screws, bolts, adhesives, rivets, welds, and the like. In this embodiment, guide housing 40 is configured with a channel 22, which may limit the travel of indicator 24. By limiting the movement of indicator 24, which is coupled to extension member 14, it will also limit the rotation of securing member 12. Indicator 24 is configured to indicate the position of extension member 14 and securing member 12. Although indicator 24 is shown as generally round, other shapes and configurations may be utilized, as desired.

With this configuration, extension member 14 is telescoping with respect to receiving member 20, in that it will extend further into receiving member 20 as indicator 24 moved generally downwardly in channel 22, and will move away from receiving member 20 as indicator 24 moves generally upwardly in channel 22.

System 10 typically includes one or more base members 30, which may couple to extension receiving member 20 and/or to guide housing 40, and/or may also couple to each other. The base member 30 typically includes a tab 34, which is configured to extend between decking to couple the base member 30 to decking. Tab 34 may inhibit the movement, and/or the rotational movement of the base member 30, and consequently the system 10, with respect to the decking. Base members 30 are configured to transfer the load of the systems and objects supported. Base members 30 may also add stability to the system 10 via their shape and size and thereby decrease the likelihood that system 10 may move or tip over. It will be appreciated that the size, shape and configuration of base members 30 will depend upon the decking system and upon the characteristics of the load to be supported by the system.

With this system, plants, ornaments, flags, and other things may be secured to decking in areas where wind or other forces may act upon a securing system. It will be appreciated that although two base members 30 are shown, one or more base members may be utilized, as desired. Furthermore, although base members 30 are shown as generally semi-circular, other configurations, such as, but not limited to, square, triangular, and other polygonal shapes, and other shapes, may be utilized, as desired. FIG. 1 shows the deck securing system in the unsecured position, as indicated by indicator 24.

Extension member 14 may be of varying lengths as desired. Furthermore, components of the system may be of different sizes depending on the system's intended use, and the object or load to be secured. All components of the system are typically made from a rigid material, such as metal. However, it will be appreciated that other materials, such as but not limited to, plastic, and/or wood, may be utilized as needed or desired.

Figure 2:
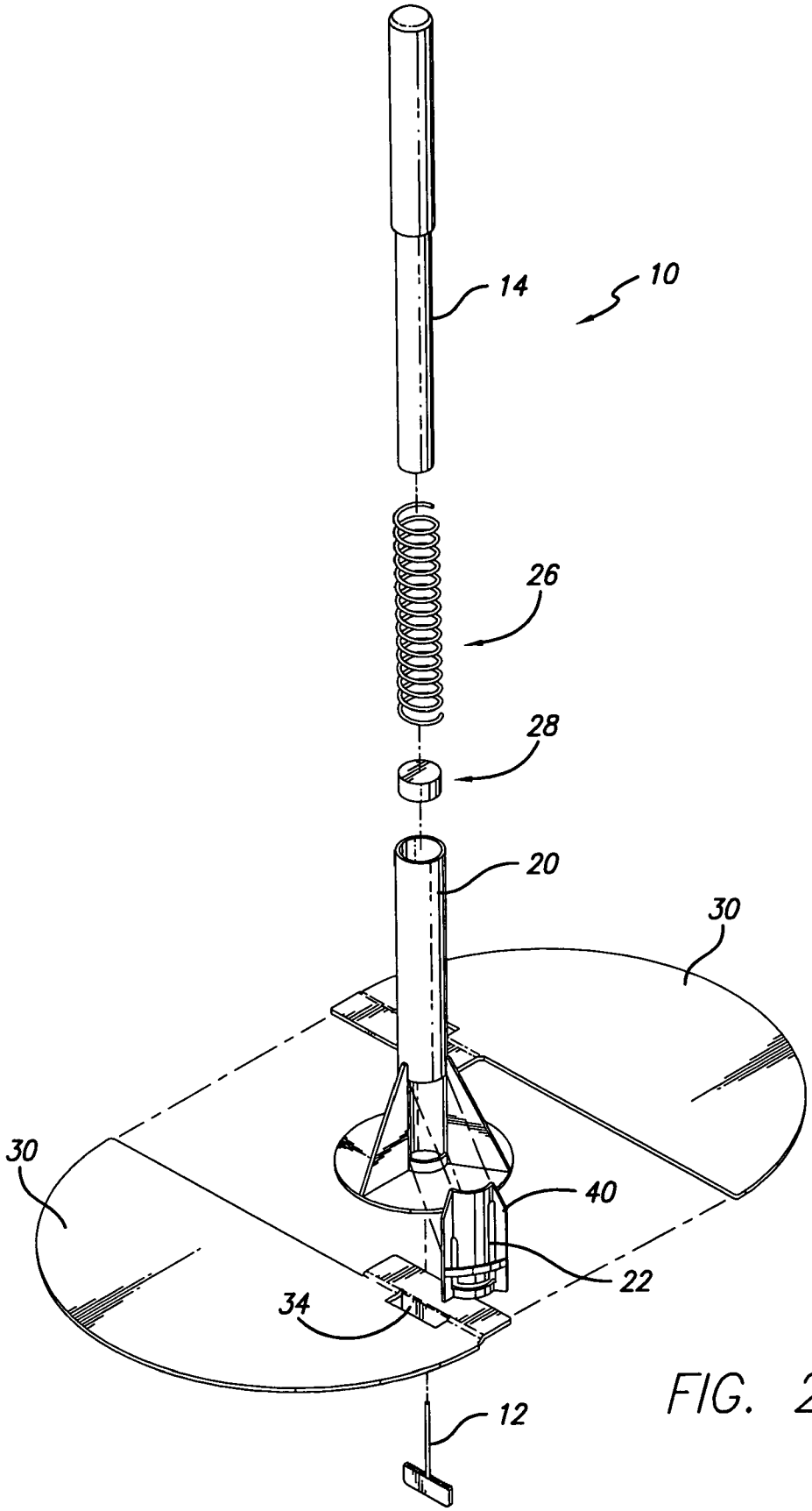
FIG. 2 is an exploded view of the embodiment of a deck securing system depicted in FIG. 1.

FIG. 2 shows an exploded view of the exemplary embodiment of a deck securing system of FIG. 1, generally at 10. System 10 again includes an extension member 14 as well as an extension receiving member 20. Furthermore, extension member 14 may couple to a securing member 12, via a weld, adhesive or other methods of coupling. Alternatively, securing member 12 may be integral with extension member 14.

System 10 may also include a biasing member 26, which is configured to bias extension member 14 with respect to extension receiving member 20. System 10 may further include an anchor 28 which may be configured to anchor biasing member 26.

Securing member 12 is configured to extend between decking and be rotated and allowed to bias back toward the system 10 to secure the system 10 to the decking.

Again, system 10 includes a guide housing 40, which may include a channel 22. An indicator 24 (not shown) may travel within channel 22, and may be coupled to extension member 14, such that the indicator may limit the movement of extension member 14 and consequently securing member 12. In this manner, extension member 14 may be moved toward extension receiving member 20 to extend securing member 12 between decking. This will cause indicator 24 (not shown) to travel downwardly in channel 22. Extension member 14 may then be rotated as allowed by channel 22 such that securing member 12 may rotate a predetermined distance. When the indicator rotates over to the opposite side of channel 22, the biasing member 26 then biases extension member 14 back toward the system, and securing member 12 may secure to the bottom of decking.

System 10 again includes one or more base members 30, which may couple together and/or may also couple to extension receiving member 20. In this embodiment, base member 30 includes a tab 34, which may extend between decking members which may limit rotation of the system or movement with respect to the decking. Base members 30 may couple to extension receiving member 20 as well as to each other, as desired. These components may be coupled together via screws, bolts, rivets, adhesives, and by interference fit, among others, or other coupling configurations and/or methods, as desired. Although two base members 30 are shown, it will be appreciated that any number of base members may be utilized, including one, with different configurations, as needed or desired.

In this embodiment, extension member 14 is configured to couple to extension receiving member 20 via indicator 24 (not shown), as well as via biasing member 26. It will be appreciated that other coupling configurations may be utilized, as desired. Furthermore, extension member 14 is configured to extend into extension receiving member 20, and moves and rotates with respect to extension receiving member 20 in a generally telescoping and rotational manner. It will be appreciated that other configurations may be utilized, as desired. In this manner extension member 14 may move with respect to extension receiving member 20, while being springedly coupled to it.

Figure 3:
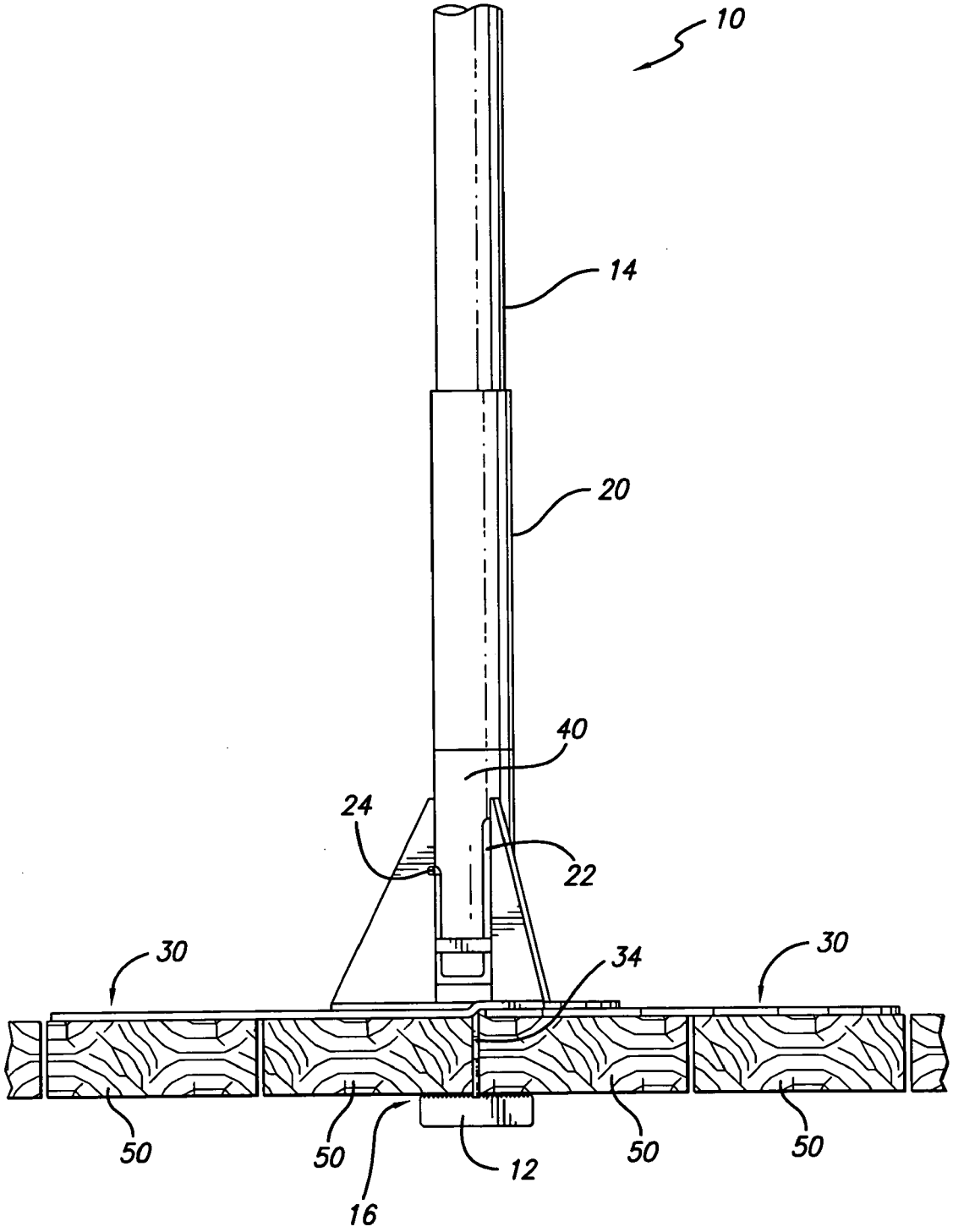
FIG. 3 is a perspective view of an exemplary embodiment of a deck securing system, secured to typical decking having spaced members.

FIG. 3 shows a deck securing system 10 in a secured position. The secured position is when the securing member 12 has been extended between decking members 50 and has rotated and is now biased back toward the system to secure the system to decking 50. Indicator 24 now indicates that the securing member 12 is in the secured position and rotated with respect to the system 10.

System 10 may again include an extension member 14, which is configured to extend through extension receiving member 20, and couple to securing member 12. System 10 may again include an indicator 24 which may couple to extension member 14 and may move within channel 22 of guide housing 40. Again, system 10 may include one or more base member 30 that may couple to extension receiving member 20, and also may couple to each other.

Securing member 12 may include gripping structure 16, which may enhance the coupling of securing member 12 to the decking or other structure to be coupled to by embedding partially therein. Although a generally serrated configuration is shown for gripping structure 16, it will be appreciated that other gripping and/or securing structures may be utilized, as desired. The various components of the system may be fabricated from metal, plastic, polymers, wood, or combinations thereof, or other materials, as desired.

To utilize the system, a user would place system 10 on top of typical decking members 50 with securing member 12 extending there between. The user would then extend securing member 12 generally downwardly between the decking members 50 by exerting a generally downward force on extension member 14. The user would then rotate extension member 14, thereby rotating securing member 12. The biasing member 26 would then bias securing member 12 back toward the system 10, thereby allowing securing member 12 to contact decking members 50. This would then secure the system 10 to the decking to allow a user to couple various objects and loads, such as flags, umbrellas, planters, kites or other objects to the upper end of extension member 14.

In closing, it is to be understood that the exemplary embodiments described herein are meant to be merely illustrative of the principles of the present invention. Other modifications that may be employed are within the scope of the various disclosed embodiments. Thus, by way of example, but not of limitation, alternative configurations may be utilized in accordance with the teachings herein. Accordingly, the drawings and descriptions are illustrative and not meant to be a limitation thereof. Thus, it is intended that the invention cover all embodiments and variations thereof as long as such embodiments and variations come within the scope of the appended claims and their equivalents.

What is claimed is:

1. A deck securing system for securing objects to decking, comprising:

an extension member;

a securing member coupled to said extension member, configured to move between a first secured and second unsecured position;

a receiving member springedly coupled to said extension member;

an indicator configured to indicate the position of said securing member;

a base member operatively coupled to said receiving member, wherein said base member comprises a tab configured to extend between decking;

a biasing member configured to bias said extension member with respect to said receiving member; and a guide housing coupled to said receiving member.

2. A deck securing system for securing objects to decking, comprising:

an extension member;

a securing member coupled to said extension member, configured to move between a first secured and second unsecured position;

a receiving member springedly coupled to said extension member;

an indicator configured to indicate the position of said securing member;

a base member operatively coupled to said receiving member, wherein said base member comprises two semicircular portions configured to couple together;

a biasing member configured to bias said extension member with respect to said receiving member; and a guide housing coupled to said receiving member.

3. A deck securing system, comprising:

a first member extending over a base;

a second member coupled at one end to said base and adapted to resiliently receive at least a portion of said first member, said resiliently received first member configured to move within said second member;

a deck securing member coupled to said resiliently received first member and configured to rotate relative to said base between a first unsecured deck position and a second secured deck position;

at least one guide channel being formed proximate to said base-coupled end of said second member;

a curvilinear track being defined by said at least one guide channel; and at least one movement indicator on said resiliently received first member, said at least one movement indicator being adapted to travel along said curvilinear track as said deck securing member rotates relative to said base between said first unsecured deck position and said second secured deck position.

4. The deck securing system of claim 3, wherein said at least one guide channel is being provided as part of a guide housing secured to said base-coupled end of said second member.

5. The deck securing system of claim 3, wherein said at least one guide channel is substantially J-shaped.

6. A deck securing system, comprising:

a first member extending over a base;

a second member coupled at one end to said base and adapted to resiliently receive at least a portion of said first member, said resiliently received first member configured to move within said second member;

a deck securing member coupled to said resiliently received first member and configured to rotate relative to said base between a first unsecured deck position and a second secured deck position, said deck securing member being provided with a base gripping structure, said base gripping structure having a substantially serrated configuration; and at least one movement indicator on said resiliently received first member being adapted to travel along a curvilinear track as said deck securing member rotates relative to said base between said first unsecured deck position and said second secured deck position.

7. A deck securing system, comprising:

a base including two overlapping portions configured to couple together;

a first member extending over said base;

a second member coupled at one end to said base and adapted to resiliently receive at least a portion of said first member, said resiliently received first member configured to move within said second member;

a deck securing member coupled to said resiliently received first member and configured to rotate relative to said base between a first unsecured deck position and a second secured deck position; and at least one movement indicator on said resiliently received first member being adapted to travel along a curvilinear track as said deck securing member rotates relative to said base between said first unsecured deck position and said second secured deck position.

8. The deck securing system of claim 7, wherein at least one of said overlapping base portions includes at least one tab configured to extend between decking.

9. The deck securing system of claim 8, wherein said at least one tab is formed via a partial cutout in at least one of said overlapping base portions.

10. The deck securing system of claim 7, wherein said coupled overlapping base portions exhibit a substantially circular configuration.

11. A deck securing system, comprising:

a base;

a first member extending over said base;

a second member coupled at one end to said base and adapted to receive at least a portion of said first member;

at least one spring operatively coupled between said first and second members, said at least one spring allowing said received portion of said first member to move resiliently within said second member;

a deck securing member coupled to said received portion of said first member and configured to rotate relative to said base between a first unsecured deck position and a second secured deck position; and at least one movement indicator on said received portion of said first member being adapted to travel along a curvilinear track as said deck securing member rotates relative to said base between said first unsecured deck position and said second secured deck position.

12. The deck securing system of claim 11, wherein one end of said at least one spring is anchored within said second member and another end of said at least one spring is engaged by a portion of said first member.

13. The deck securing system of claim 12, wherein said at least one spring is adapted to bias said deck securing member toward said base in said first unsecured deck position and said second secured deck position.

* * * * *